US012428114B1

(12) United States Patent
Cecot et al.

(10) Patent No.: US 12,428,114 B1
(45) Date of Patent: Sep. 30, 2025

(54) DOCKING DEVICE

(71) Applicant: Cendron Industries LLC, York, ME (US)

(72) Inventors: Joshua Cecot, York, ME (US); Roland Gendron, North Waterboro, ME (US); Steven Gendron, York, ME (US)

(73) Assignee: Cendron Industries LLC, York, ME (US)

( * ) Notice: Subject to any disclaimer, the term of this patent is extended or adjusted under 35 U.S.C. 154(b) by 0 days.

(21) Appl. No.: 19/196,281

(22) Filed: May 1, 2025

Related U.S. Application Data

(60) Provisional application No. 63/742,038, filed on Jan. 6, 2025.

(51) Int. Cl.
*B63C 3/02* (2006.01)

(52) U.S. Cl.
CPC ..... *B63C 3/02* (2013.01)

(58) Field of Classification Search
CPC ..... B63C 3/02
See application file for complete search history.

(56) References Cited

U.S. PATENT DOCUMENTS

| | | | | | |
|---|---|---|---|---|---|
| 2,662,501 | A * | 12/1953 | Bascome, Jr. | E02B 3/24 | 114/230.19 |
| 3,763,816 | A * | 10/1973 | Wilson, Jr. | B63C 1/10 | 114/263 |
| 4,351,259 | A * | 9/1982 | Loire | E02B 3/24 | 114/230.19 |
| 5,174,234 | A * | 12/1992 | Ryan | B63C 3/06 | 114/230.1 |
| 5,666,901 | A * | 9/1997 | Jones | B60P 3/1066 | 280/414.1 |
| 6,145,461 | A * | 11/2000 | VanAssche | B63B 21/00 | 114/230.1 |
| 11,319,036 | B2 * | 5/2022 | Duggal | B63B 21/00 | |
| 11,724,779 | B2 * | 8/2023 | Sun | B63B 21/10 | 114/343 |
| 2002/0152944 | A1 * | 10/2002 | Ryan | B63B 21/00 | 114/230.1 |
| 2016/0159447 | A1 * | 6/2016 | Parker | B63C 3/06 | 405/3 |
| 2023/0022064 | A1 | 1/2023 | Yao | | |

* cited by examiner

*Primary Examiner* — S. Joseph Morano
*Assistant Examiner* — Jovon E Hayes

(57) ABSTRACT

A docking device for a multihull watercraft that is configured to guide the watercraft into the device and secure it in place after the docking position is established.

11 Claims, 5 Drawing Sheets

DOCKING DEVICE

BACKGROUND INFORMATION

Field of the Invention

The invention relates to a watercraft docking system, and in particular docking systems for watercraft that have multihull designs.

Discussion of Prior Art

Multihull watercraft, such as pontoon and tritoon boats, are widely used for recreational purposes, including leisure cruising, fishing, and social activities on the water. However, docking and mooring these types of multihull watercrafts, which are distinct from traditional monohull vessels due to their unique hull designs, often present significant and unique challenges, particularly relative to those monohull vessels for which most docks are designed. For example, both pontoon and tritoon boats generally have a shallow draft and include a wider beam, making them more susceptible to drifting in currents or wind while attempting to dock. This often results in docking maneuvers that require greater skill and attention, increasing the risk of damage to the watercraft, the dock, or surrounding structures and increasing the danger to the people involved.

Current docking systems and devices, such as traditional fenders, mooring lines, and mechanical docking devices, often fall short in addressing the specific needs of multihull watercraft. While pontoon and tritoon boats are typically more stable at rest compared to smaller vessels, their design, particularly the wide, flat-bottomed hulls that are supported by two or more pontoons, necessitate a docking solution that accommodates the watercraft's wider profile and ensures safe, secure positioning during the docking process.

Additionally, existing dock-mounted systems may not offer sufficient flexibility to adapt to the varying sizes of pontoon boats and other multihull watercraft, or they may require significant manual intervention for proper alignment and securing of the boat. Conventional docking devices are often not designed for the particular handling characteristics and mooring requirements of multihull watercraft, leading to challenges in docking efficiency and safety, especially in adverse weather conditions or under low visibility.

Thus, there is a need for a watercraft docking device that is specifically designed to facilitate the safe, efficient, and secure docking of such multihull watercraft. In particular, a docking device that is capable of accommodating a variety of watercraft sizes and configurations, that provides stability during docking maneuvers, and that reduces the risk of damage to the watercraft and surrounding dock. Furthermore, it should be designed to minimize the effort and skill required by the watercraft operator, particularly in conditions where traditional docking methods may be difficult to perform. The present invention addresses these needs by providing an innovative docking solution tailored to the unique characteristics of multihull watercraft.

BRIEF SUMMARY OF THE INVENTION

The invention is a watercraft docking device that guides and secures a watercraft into a dock, making the docking process simple and that requires only the operator of the watercraft to complete. The device is configured to be attached either directly to the shore or to an existing dock and is comprised of structural elements such as pipes, planks or beams, which are assembled to form a rectangular shape with one shorter end attached to the shore or existing dock and the two longer pieces protruding out into the water to guide the watercraft into the dock and secure the watercraft to the shore or dock. In use, the watercraft is driven into the dock over the pipes, planks, or beams, which act as friction tubes, creating friction against the watercraft to slow the watercraft as it enters the dock, and the watercraft is then guided by the longer protruding components, or guide tubes, allowing the operator to safely and conveniently ease the watercraft into the dock.

Additionally, the structural elements are comprised of materials that have natural flotation, which helps to keep the watercraft in place once it comes to its docked position. Once the watercraft operator is ready to exit the watercraft, they do so through a conventional front door of the watercraft and are able to secure the watercraft further using a rope, preferably with a carabiner for ease, tied off to a secure place on the watercraft. When the operator is ready to remove the watercraft from the dock they simply remove the tie off, if previously tied, and reverse out off of the docking system.

While the primary purpose of the invention is to improve the ease of docking a watercraft there are a number of additional benefits. First, it increases accessibility for people who may be handicapped or elderly, and would allow for those with mobility issues to dock the watercraft on their own—in particular, someone who requires the use of a wheelchair may simply wheel onto the watercraft on their own after removing the tie off, if previously tied, without any concern for the watercraft floating away from the shore or dock and reverse the watercraft off the docking system and then pilot up to the docking system, dock the watercraft, and exit the watercraft without any concern of the watercraft floating away from the shore or dock.

Second, it has an ease of use for inexperienced boaters and/or for those in challenging conditions, e.g. wind, rough waters, etc. as the guiding system makes it easy to direct the watercraft forward toward the target and seamlessly up to the shore or dock, as opposed to guiding the watercraft using more advanced skill up to the side of a dock where they must then ensure they remain still alongside the dock in order to secure the watercraft, and which typically may only be done with someone else on the dock or watercraft to assist and with multiple attempts.

A third advantage relates to the safety and security of the watercraft while it is docked. The watercraft is essentially "locked in" and will be able to sustain rough waters and high winds without the risk of being pulled away and/or damaging a dock. The security of the watercraft moving side to side or in any way away from the shore or the dock is much greater than when the watercraft is tied to the shore or dock using one or two ropes. This is due to the guide tube's restriction of the watercraft moving side to side and the docking system's friction and flotation against the watercraft creating a "lock" of the entire watercraft.

Fourth, it is adaptable to property and it has simplicity. Where traditional docks may be challenging to install given different landscapes and space along the water, the inventive docking system may be installed directly onshore or attached to any existing dock and typically may be put in or taken out simply by one person.

A fifth advantage is that when it is used in connection with an existing dock it increases the docks utility and also requires less dock length than is necessary to dock a watercraft on its own. Using the current method to dock a watercraft, the watercraft sits alongside the dock lengthwise, requiring at minimum the length of the dock to equal the length of the watercraft, and where the watercraft then take up one entire side of the dock. With the inventive system, the amount of dock space needed is barely more than the width of the watercraft, which is typically 8 to 10 feet, versus the length of the craft, which is typically 20 to 25 feet, and which allows for additional watercraft to be docked on the same dock as opposed to a maximum of 2 watercrafts where watercraft is on either side of the dock, and instead 4 watercrafts may fit and be easily docked.

A sixth advantage is that the inventive system is significantly less expensive than conventional alternatives. This is due to the fact that both the cost of the physical components that combine to form the structure as well as the cost of labor that goes in to designing and subsequently assembling the components are less expensive than with conventional docks.

Lastly, the inventive docking device is extremely lightweight, easy to assemble and disassemble, and portable. Whereas traditional docks are not easily moved or transported given the size and weight of the dock and usually requires several people to move, the inventive docking device is lightweight and may be moved by one person and attached to any existing dock or to the shore of any body of water, requiring only about 8 feet of waterfrontage or dock space. Transport is made easy-simply place the docking system into the watercraft and drive the watercraft onto the trailer for complete portability. Assembling and disassembling the individual components that form the docking device is also easy such that, in addition to being able to easily transport the fully assembled device, it is also comparatively easy to break apart the components for transport or storage.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

Figure 1:
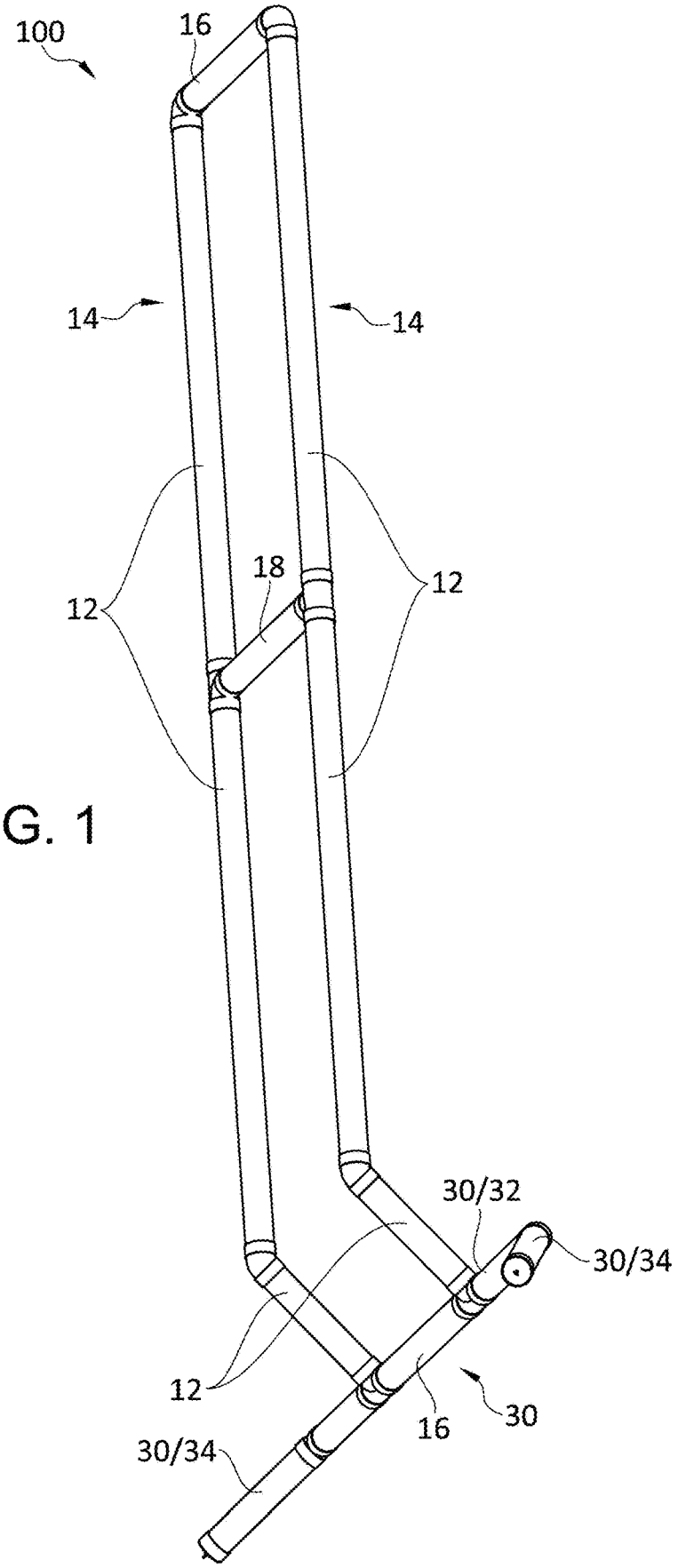
FIG. 1 is perspective view of the docking device according to the invention, which is particularly advantageous for multihull watercraft.
Figure 2:
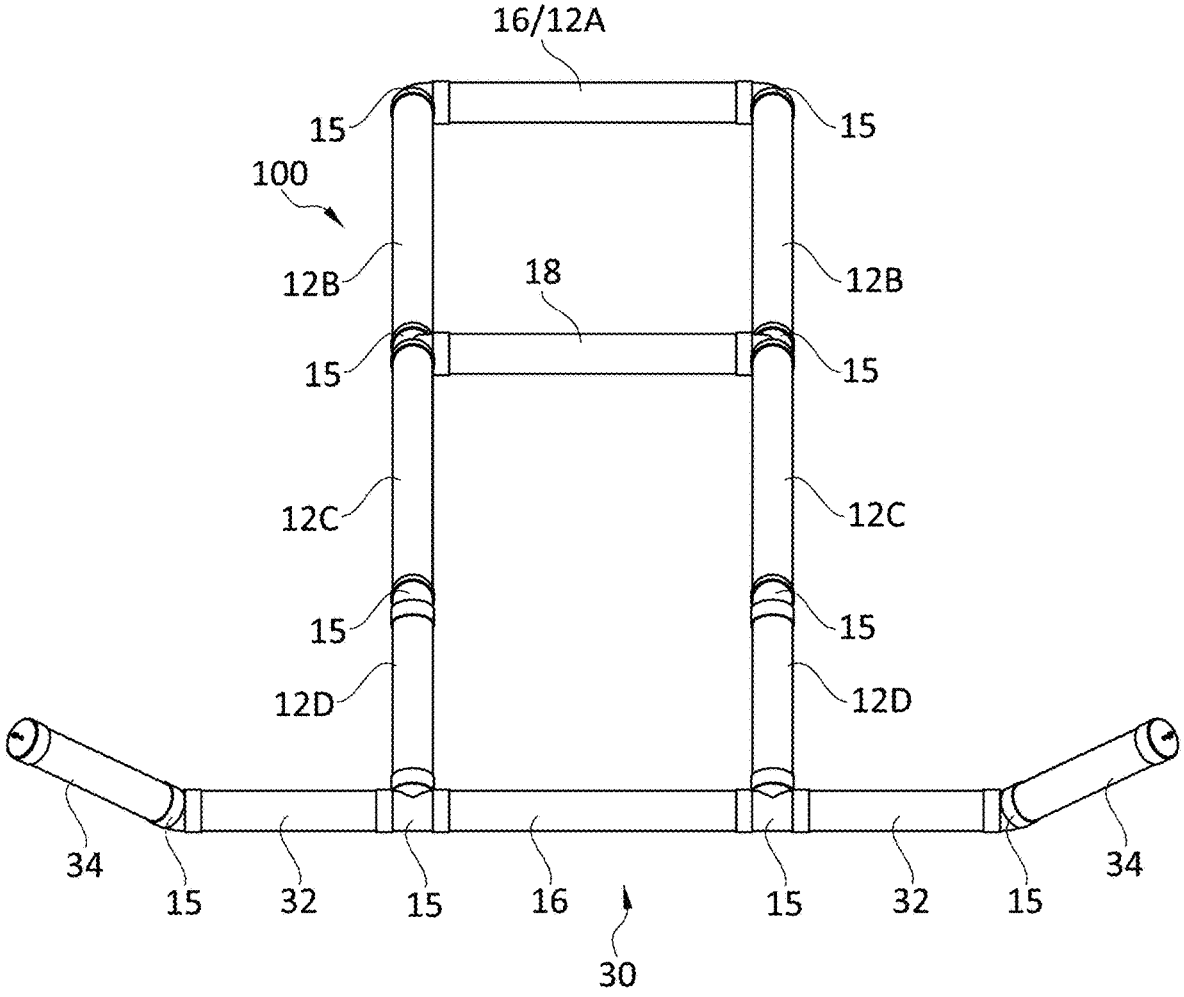
FIG. 2 is a perspective view of the device showing the guide body attached to the main body.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

FIGS. 1-5 illustrate a watercraft docking device 100 according to the invention. The docking device 100 has a main body 10 that is comprised of one or more conduits 12, which are made of a buoyant material and configured to have two sides 14 that are substantially parallel to one another and connected by end segments 16. The docking device 100 also includes a guide body 30 that is formed from one or more conduits 32, the guide body 30 being attached to or incorporating an end segment 16 of the main body 10. An end segment 16 that is opposite the guide body 30 is configured to attach to a shorefront or to an existing docking or step structure.

In use, the docking device 100 is placed in a body of water with the guide body 30 extending out into the waterbody and with the opposite end segment 16 attached a land area or to another docking structure. The buoyancy of the conduits 12 causes the docking device 100 to float at, on, or near the surface of the body of water. A watercraft, such as a pontoon boat, may be driven into the guide body 30 where guide features help to direct the watercraft over the sides 14 of the device 100, such that there is one pontoon located on either side 14 of the docking device. The guide body 30 also serves as a source of friction, the guide body 30 including buoyant segments that are in the form of friction tubes, and where the friction that is cause by the watercraft passing over the friction tubes helps to slow the speed of entry into and/or onto the docking device 100 while also securing the watercraft in position on the docking device 100 once it is fully docked.

In the embodiment shown in the figures, the main body 10 is comprised of nine separate conduits 12 that are connected by couplings 15. In this embodiment, there is one conduit 12A that is one of the end segments 16 and that is attachable to land or an existing dock. Each side 14 includes two conduits 12B, 12C that run substantially parallel to one another and where each section 12B has substantially the same length and each section 12C has substantially the same length. Each side 14 also includes a pair of conduits 12D that have a downward angle, for example, they may be angled downward between 20 and 60 degrees relative to the other side conduits 12B, 12C. A side support brace 18 or side member 18 connects and stabilizes conduits 12B and 12C. The downward conduits 12D are connected by an end conduit 16.

In the embodiment shown, the guide body 30 incorporates the end conduit 16, and is itself comprised of conduits 12. Additionally, the guide body 30 includes two conduits 32 that extend directly out at substantially 90-degree angles from the end conduit 16, and that connect to a pair of conduits 34 that are angled upward. The upward angle may vary, and anything from 15 degrees to 75 degrees is suitable with an angle around 30 degrees being preferred. Again, the function of the angled guide conduits 34 is to help direct the pontoons over the main body and the angles are set accordingly.

With this specific embodiment, the watercraft first comes into contact with the friction tube 12E, which is perpendicular to the long guide tubes 12B, 12C, 12D. The friction tube 12E naturally floats until the watercraft makes contact, after which the friction tube 12E is pushed under water by the pontoons which slows the watercraft. As the watercraft moves into the dock the watercraft passes over the long guide tubes 12B, 12C, 12D. In the case of a pontoon boat, the long guide tubes 12B, 12C, 12D prevent the pontoons moving side to side by being above the water line and just below the deck of the boat.

Additionally, suitable types of strapping or cordage may be secured to the device 100 and used to further secure a watercraft to the dock 100, primarily for use during times of inclement weather. For example, ropes, straps, or wires may be attached to the ends of conduits 12F and then looped over a pontoon on a pontoon boat to tie the boat in position on the docking device 100.

In multiple-conduit embodiments the various conduits 12 may be attached in a variety of manners. For example, they may be attached to the coupling 15 by adhesives, such as glues that are particularly well suited for water-environments. The conduits 12 may also be attached by threaded fasteners, for example, the end of the conduits 12 and couplings 15 may be configured to have threaded connectors.

Figure 5:
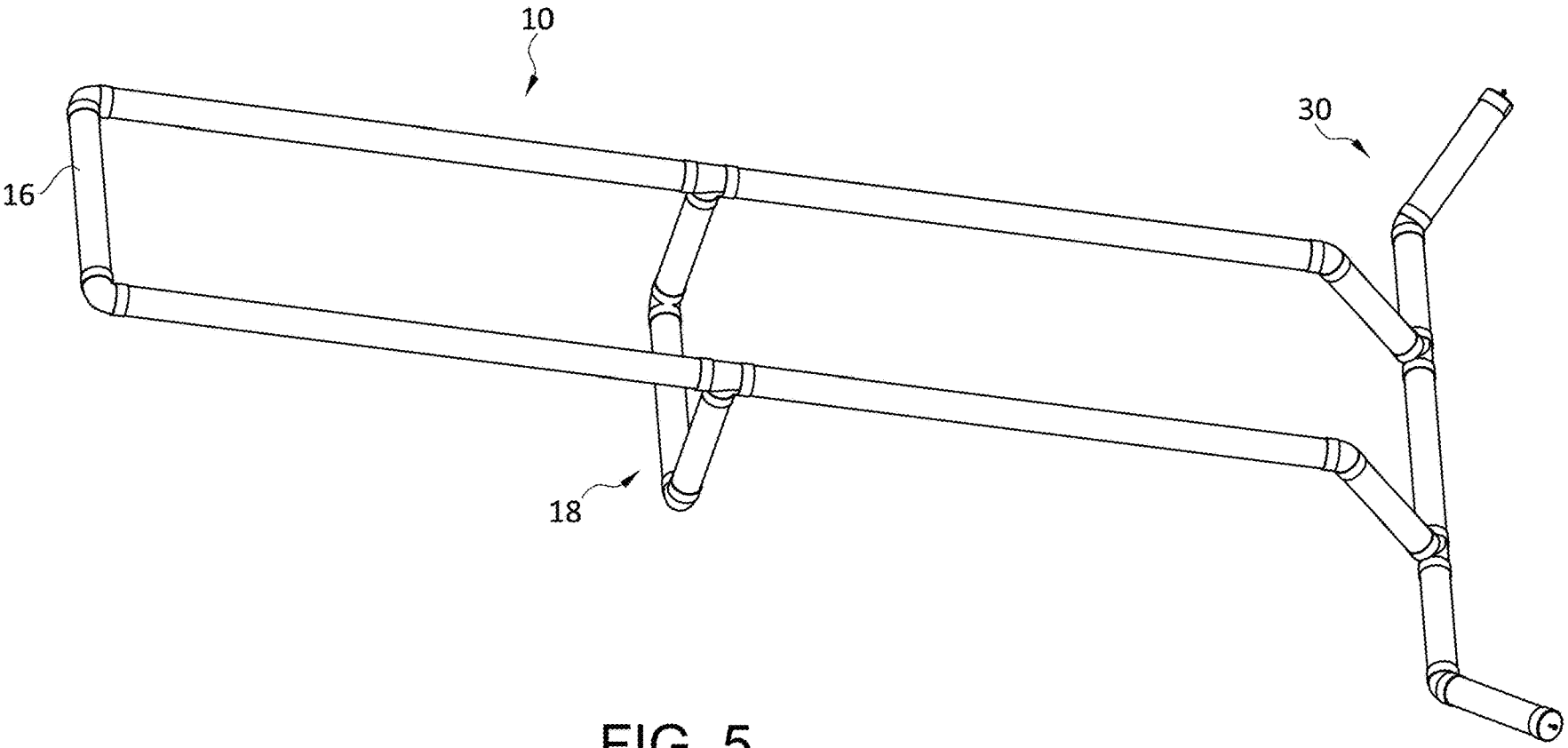
FIG. 5 is a perspective view of an embodiment of the docking device that is particularly useful with a tritoon style hull.

FIG. 5 illustrates an embodiment of the docking device 100 that is particularly advantageous for tritoon style hulls, with the side brace 18 having a generally u-shape, and configured with multiple conduits to extend under and around the middle hull in the three-hull design.

The docking device 100 may be comprised of a number of suitable materials. For example, conduits made of polyvinyl chloride ("PVC") are particularly well suited for this application. The device may also be made of, for example, high-density polyethylene ("HDPE), polypropylene, wood, or it could be made of inflatable materials. In many embodiments all of the components are buoyant, however, only the friction tubes 12E need to be buoyant in order for the device 100 to function as intended.

Figure 3:
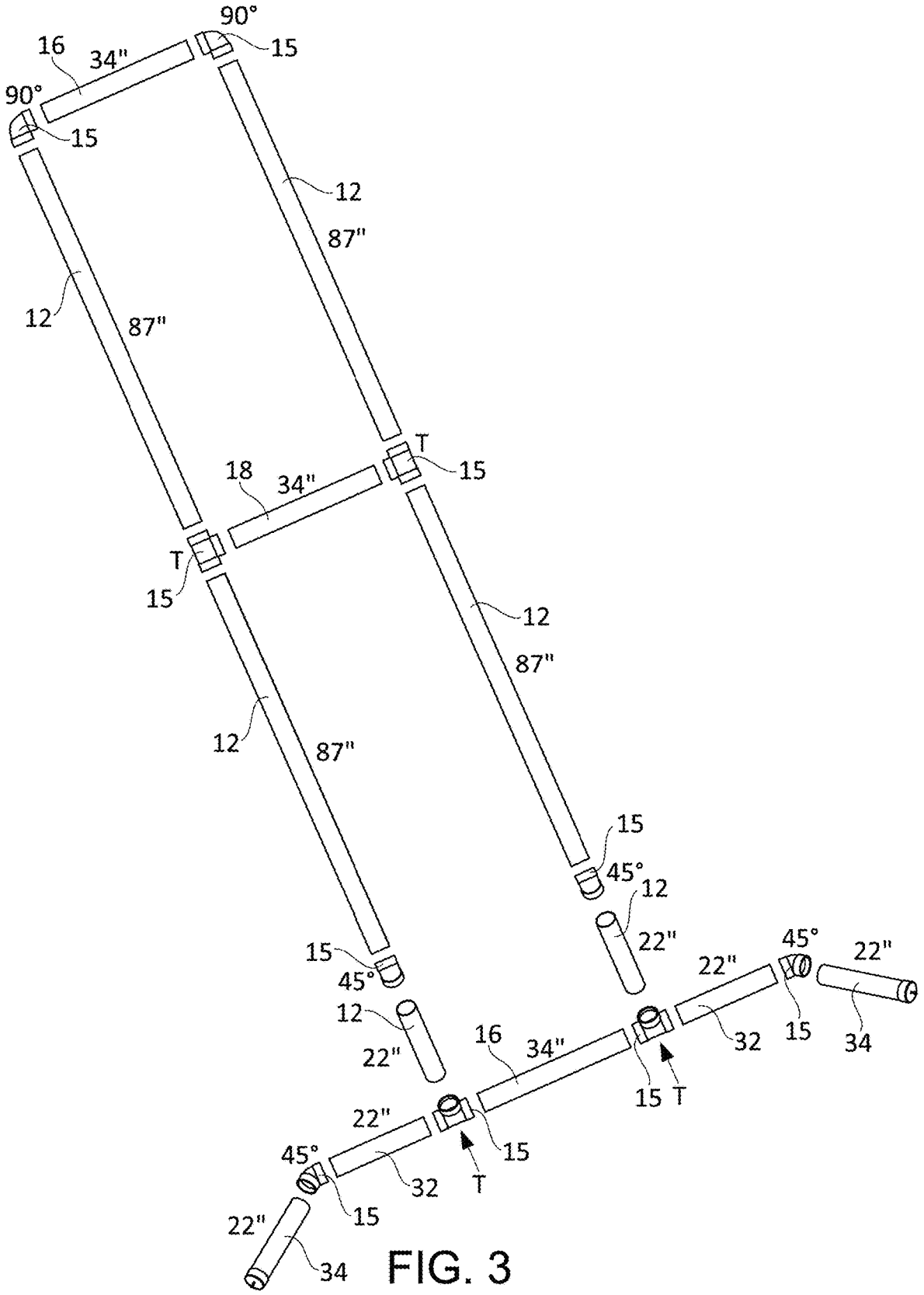
FIG. 3 is a top view of the device with the components separated and measurements showing one functional example.
Figure 4:
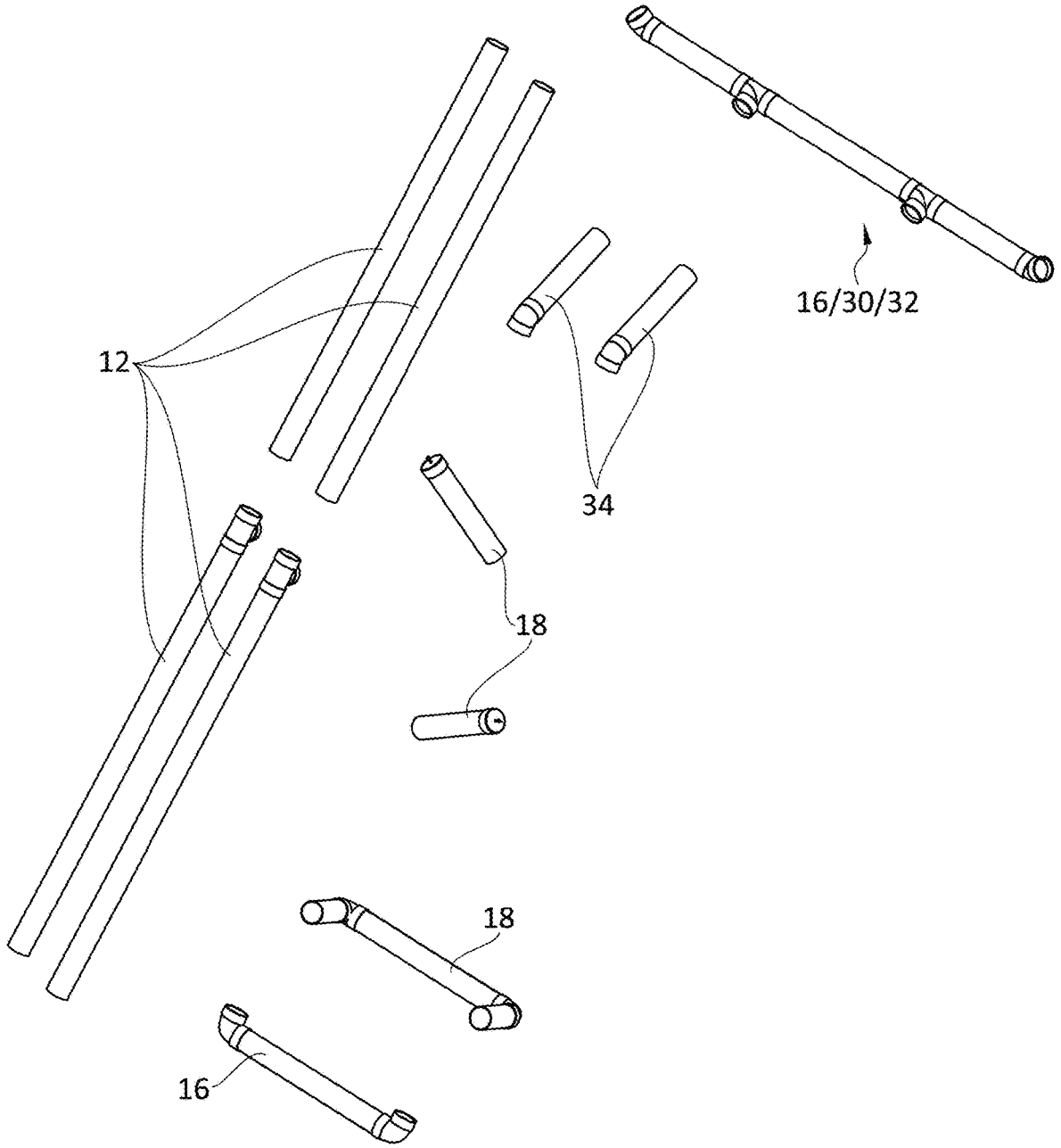
FIG. 4 is a top perspective view of the components in separated form.

FIG. 3 illustrates the specific dimensions of one embodiment that is made of PVC products. This model is only one example and many other embodiments are possible.

It is understood that the embodiments described herein are merely illustrative of the present invention. Variations in the construction of the watercraft docking device may be contemplated by one skilled in the art without limiting the intended scope of the invention herein disclosed.

What is claimed is:

1. A docking device adapted to secure a watercraft that has at least a first hull and a second hull, the docking device comprised of:

a main body that includes a plurality of main body conduits that are configured to secure the watercraft in a docked position, at least two of the plurality of main body conduits positioned as a first side and second side of the main body, the first side and second side configured as opposing sides that are substantially parallel to one another, the main body further having a first end and a second end;

the first side and the second side having, respectively, a first side end section and a second side end section, each of the first side end section and the second side end section comprising a conduit coupled to an end of the first side and the second side, each of the first side end section and the second side end section angled downward in a vertical plane;

a guide body that includes a plurality of guide body components and that is coupled to an end portion of the first end section and an end portion of the second end section, the guide body having at least a first guide body conduit and a second guide body conduit, the first guide body conduit coupled to the first side end section and the second guide conduit coupled to the second side end section, the first guide body conduit and second guide body conduits each, first, extending outward and away from the main body first in approximately a horizontal plane and, then, at an upward angle, the guide body adapted to guide the watercraft into the docked position over the main body with the first hull on one side of the main body and the second hull on an opposite side of the main body.

2. The docking device of claim 1, wherein at least some portion of the guide body is comprised of a buoyant material.

3. The docking device of claim 2, wherein at least some of the guide body conduits are friction tubes that create friction to slow the watercraft as it enters the docking device.

4. The docking device of claim 1, wherein the first and second sides are positioned to fit between the first hull and second hull.

5. The docking device of claim 4, wherein a brace member is coupled to the first side and the second side and configured to secure the first and second side in a fixed positioned relative to one another.

6. The docking device of claim 5, wherein the brace member is a conduit that extends in a substantially straight line between the first side and the second side.

7. The docking device of claim 5, wherein the brace member is comprised of a plurality of conduits that are combined to be in a substantially u-shape and sized to allow for a third hull of the watercraft to be positioned between the first side and the second side.

8. The docking device of claim 1, wherein the plurality of main body conduits and the plurality of guide body components are comprised of a rigid material.

9. The docking device of claim 1, wherein the plurality of main body conduits and the plurality of guide body components are fixedly coupled to one another.

10. The docking device of claim 1, wherein the downward angle of the first side end section and the second side end section is between 20 degrees and 60 degrees.

11. The docking device of claim 1, wherein the upward angles of the first guide body conduit and the second guide body conduit are between 15 degree and 75 degrees.

* * * * *